US005819999A

United States Patent [19]

Tennant

[11] Patent Number: 5,819,999

[45] Date of Patent: Oct. 13, 1998

[54] COMBINATION BACKPACK AND CHAIR

[76] Inventor: Brian M. Tennant, P.O. Box 1649, Hanalei, Hi. 96714

[21] Appl. No.: 405,649

[22] Filed: Mar. 17, 1995

[51] Int. Cl.[6] ..... A45F 4/02

[52] U.S. Cl. ..... 224/155; 224/153; 224/155

[58] Field of Search ..... 224/155, 148, 224/153, 156, 209; 297/188.04, 188.05, 129, 351, 440.22

[56] References Cited

U.S. PATENT DOCUMENTS

| | | | |
|---|---|---|---|
| 2,973,888 | 3/1961 | Beardsley | 224/156 |
| 3,307,758 | 3/1967 | Platt | 224/155 |
| 3,825,298 | 7/1974 | Chipman | 297/129 |
| 4,530,451 | 7/1985 | Hamilton | 224/155 |
| 4,676,548 | 6/1987 | Bradbury | 224/155 |
| 4,925,064 | 5/1990 | Comora | 224/155 |
| 4,941,603 | 7/1990 | Creamer et al. | 224/148.3 |
| 5,381,941 | 1/1995 | Brune | 224/155 |
| 5,439,153 | 8/1995 | Murdoch et al. | 224/153 |
| 5,526,969 | 6/1996 | Greenberger | 224/153 |
| 5,560,524 | 10/1996 | Brune | 224/627 |

OTHER PUBLICATIONS

Crazy Creek Products, Inc., pp. 1–10, Jan. 1994.

*Primary Examiner*—David J. Walczak
*Assistant Examiner*—Timothy L. Maust
*Attorney, Agent, or Firm*—Daniel R. Kimbell

[57] ABSTRACT

A combination backpack and chair. It has a backpack with a chair back portion located on its rear face. Chair back wings extend from side regions of the chair back portion. A seat portion extends from a lower rear region of the chair back portion. Seat wings extend from side regions of the seat portion. The seat wings and chair back wings are foldable inwardly into contact with the seat and chair back portions when the device is not being used as a chair, and these wings are foldable outwardly when the device is used as a chair. Generally rigid stays are placed in the back wings and the seat wings to provide for greater stiffening. To better maintain the shape of the device, the chair back, seat, and wings are preferably padded with foam rubber type material. Straps are provided for connecting the chair back portion and the seat back portion to allow the chair back portion and the seat portion to be maintained at a desired degree of recline relative to each other. The chair back portion and seat portion can be made to be detachably attachable to the backpack portion. The backpack portion can include a lower waterproof and insulated compartment for carrying items that are best consumed when cold, such as soft drinks.

27 Claims, 5 Drawing Sheets

COMBINATION BACKPACK AND CHAIR

BACKGROUND OF THE INVENTION

1. Field of the Invention

The invention relates to the field of backpacks, and more particularly to combination backpack and chairs.

2. Description of the Prior Art

There have been numerous attempts to develop an ideal combination backpack and seat or chair, with varying degrees of success. Some of these prior art devices are described below.

U.S. Pat. No. 3,307,758 to Platt teaches a carrying bag and back rest device. The Platt device has a rigid frame with flexible back and thigh portions, with adjustment ropes. By unfolding the device, an adjustable chair back is formed, and by folding it up a basic carrying bag, but without closed sides, is formed. When one unfolds the device, the back pack part is in effect lost.

U.S. Pat. No. 4,530,451 to Hamilton discloses a combination backpack/beach chair, where a beach chair part attaches by hooks to the backpack. Its slant adjustment straps are located behind the chair back. In use, the beach chair part is detached from the backpack part.

Three U.S. Pat. Nos. 5,289,958, 5,209,381 and 5,016,792 to Jay are all directed to a backpack convertible chair, with a rigid aluminum frame, with a bag portion which fits into a folded up frame. The rigid frame is worn against the wearer's body, and is supported off of the ground by legs.

U.S. Pat. No. 4,487,345 to Pierce et al. teaches a backpack chair which uses a frame assembly which folds into a chair, connected to a backpack. The frame is not concealed inside the backpack per se, and the systems appears to be bulky, heavy, and inflexible.

U.S. Pat. No. 4,720,029 to Varanakis discloses a folding backpack frame, which can be used to support relatively heavy objects. The frame is worn against the users body, and is not truly integrated with the backpack.

The knapsack and frame of U.S. Pat. No. 4,676,548 to Bradbury has the appearance of a normal lawn chair, and is worn against the wearer's back, as with the Varanakis system.

U.S. Pat. No. 4,392,598 to Dixon discloses a convertible backpack chair with rigid side panels. The chair back portion is retained by rails. The Dixon chair is a very rigid system, and is conceptually quite different from systems which are relatively soft and flexible.

U.S. Pat. No. 4,795,068 to Blean discloses a backpack seat which is a U-shaped bar and which is attached to a metal backpack frame, with the shoulder straps being wrapped around the U-shaped frame to provide straps on which the user will sit.

Thus, as can be seen, while there have been numerous attempts to develop an attractive, lightweight, and fairly "normal" looking combination backpack and chair, these prior art attempts have failed. There accordingly remains a need for such a combination backpack and chair.

BRIEF DESCRIPTION OF THE INVENTION

The invention provides a combination backpack and chair, comprising:

a backpack;

a chair back portion located on a rear face of said backpack;

a seat portion extending from a lower rear region of said chair back portion; and straps means for connecting said chair back portion and said seat back portion to allow said chair back portion and said seat portion to be arranged at a desired degree of recline relative to each other.

The invention further provides a combination backpack and chair, comprising:

a backpack;

a chair back portion located on a rear face of said backpack;

chair back wings which extend from side regions of the chair back portion;

a seat portion extending from a lower rear region of said chair back portion;

seat wings which extend from side regions of said seat portion, said seat wings and chair back wings being foldable inwardly into contact with the seat and chair back portions when the device is not being used as a chair, and which are foldable outwardly when used as a chair; and straps means for interconnecting said chair back portion and said seat back portion to allow said chair back portion and said seat portion to be arranged at a desired degree of recline relative to each other.

The invention yet further provides a combination backpack and chair, comprising:

a backpack;

a chair back portion located on a rear face of said backpack;

chair back wings which extend from side regions of the chair back portion;

a padded seat portion extending from a lower rear region of said chair back portion;

seat wings which extend from side regions of said seat portion, said seat wings and chair back wings being foldable inwardly into contact with the seat and chair back portions when the device is not being used as a chair, and which are foldable outwardly when used as a chair;

generally rigid stays placed in both the seat and chair back wings to provide additional stiffening;

straps means for interconnecting said chair back portion and said seat back portion to allow said chair back portion and said seat portion to be arranged at a desired degree of recline relative to each other;

adjustment means to permit adjustment of the working length of said strap means so the degree of recline between the seat and chair back portions can be adjusted; and retention means to selectively maintain said seat and chair back portions in a closed orientation when desired.

DETAILED DESCRIPTION OF INVENTION

Figure 1:
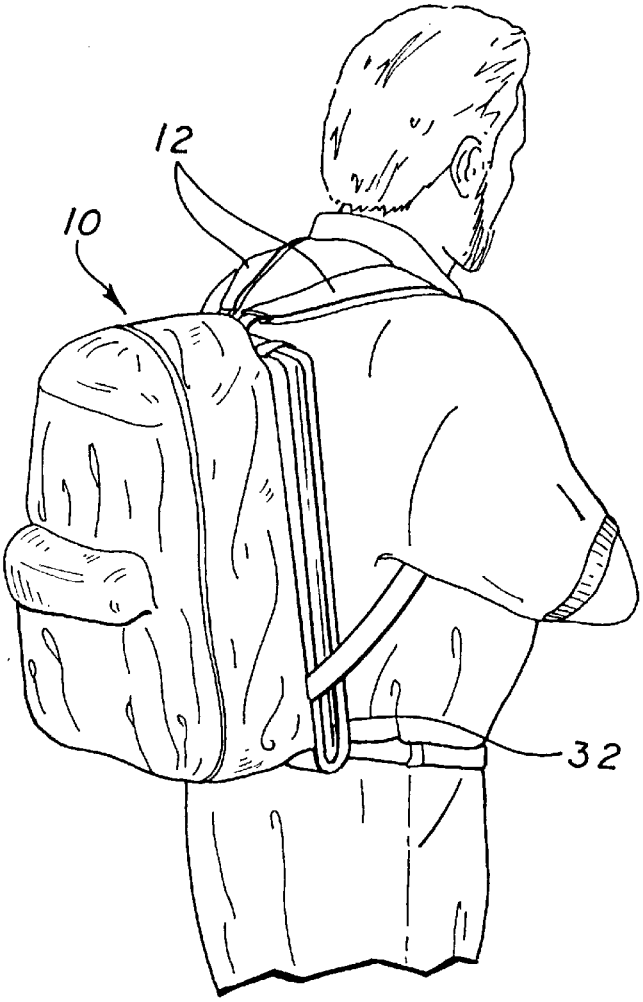
FIG. 1 is a rear side perspective view of the combination backpack and chair of the invention being worn by a wearer.
Figure 2:
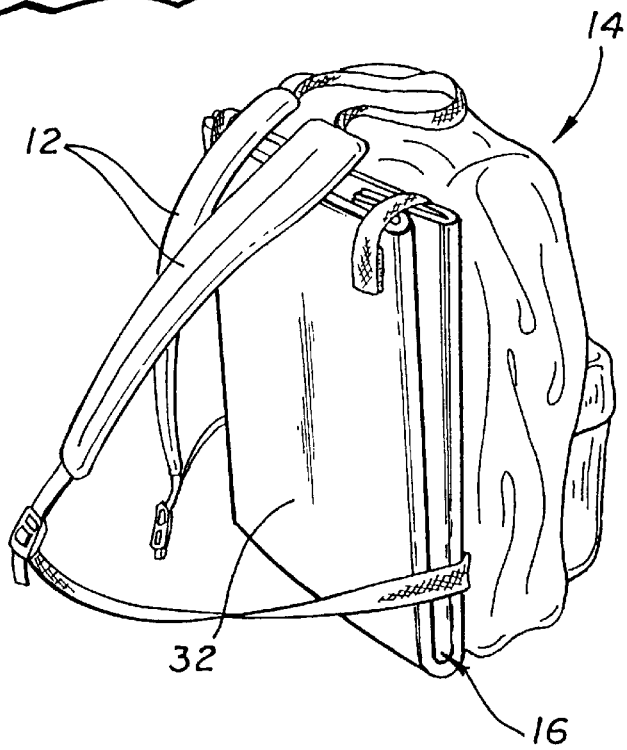
FIG. 2 is a rear side perspective view of the combination backpack and chair in its closed position.

Referring to FIGS. 1 and 2, the combination backpack and chair of the invention 10 has shoulder straps 12 for wearing on the back of a user. The backpack portion 14 of the combination backpack and chair 10 is similar to a conventional backpack, but has a chair back and seat portion 16.

Figure 3:
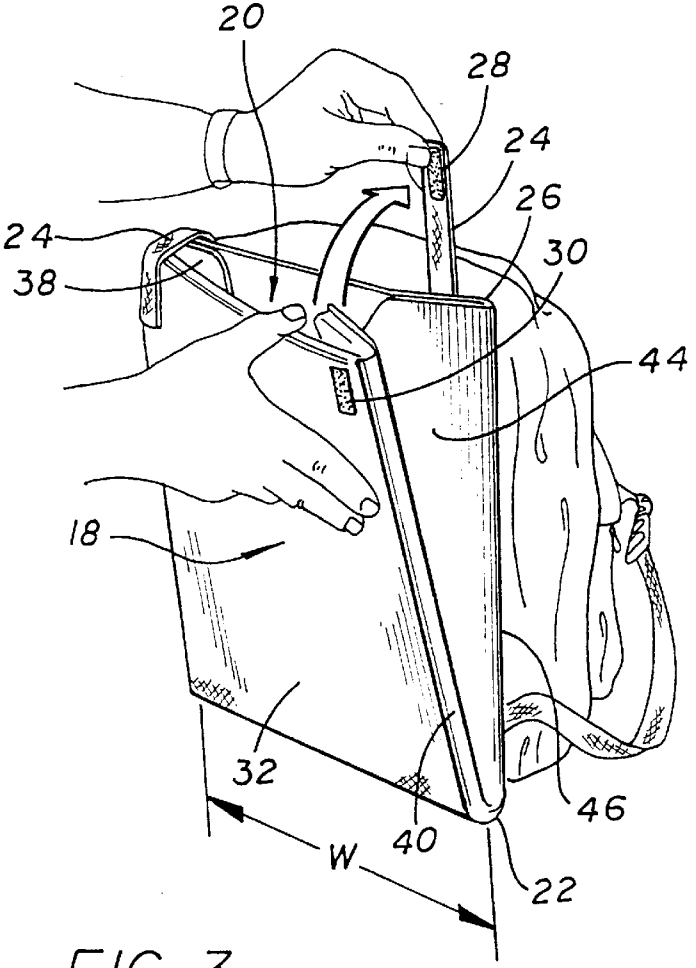
FIG. 3 is a rear side perspective view of the combination backpack and chair with its seat portion beginning to be unstrapped.

Referring to FIG. 3, a seat portion 18 is attached to a chair back portion 20 along a lower region 22. A pair of retention straps 24 are attached to an upper portion 26 the backpack portion 14 and are used to retain the seat portion 16 in a closed position against the chair back portion 20. The retention straps can utilize hook and loop material 28, such as Velcro® on its ends, with patches of complementary hook and loop material 30 locate on a bottom layer of material 32 of the seat portion 18. Alternately, other means can be utilized to selectively keep the seat portion 18 in its closed orientation adjacent the chair back portion 20, such as snaps, zippers, laces, or other means. Referring back to FIG. 1, the backpack 10 is worn with the bottom layer of material 32 of the seat portion 18 adjacent the wearer's back.

The seat portion 18 is preferably has a top layer of material 34 and a bottom layer of material 32, with a cushion material 36 (i.e. dense but lightweight foam rubber type material) sandwiched therebetween. Cushioning foam rubber type material is likewise also preferably sandwiched in the chair back portion 20 and in the seat and back wings 38 and 44. This cushioning material gives the seat a more uniform shape, and prevents excessive "hammocking" of the device when a user is seated. The top and bottom layers of material 34 and 32 can preferably be coated Nylon i.e. Cordura®, or can be canvas, leather, or any other durable material, or even plastic material. The cushion material 36 will not only provide cushion to the users when he or she is seated, but will also give the seat greater resiliency and provide a more uniform and smooth shape. A pair of seat wings 38 extend outwardly from side regions 40 of the seat portion 18. A generally rigid seat stay 42 (i.e. made from fiberglass, rigid plastic, or the like) is positioned inside each of the seat wings 38. These seat wing portions 38 are folded outwardly from the seat portion 18 when the device 10 is being prepared for use as a chair.

The chair back portion 20 has back wings 44 which extend outwardly from side regions 46 of the chair back portion 20. A pair of generally rigid chair back stays 48 (i.e. made from fiberglass, rigid plastic, or the like) are placed inside of the back wings 44. The seat wings 38 and the back wings 44 can be reinforced, as desired, i.e., with extra cushion or padding material (not shown) at their top and bottom regions to help in preventing the seat stays 42 and the chair back stays 48 from poking through their wings 38 and 44. The seat wings 38 and back wings 44 act to effectively widen the seat and back portions 18 and 20, over the normal width "W" of the seat and back portions 18 and 20, to a wider stance "EW", which creates a wider and more comfortable chair.

Figure 4:
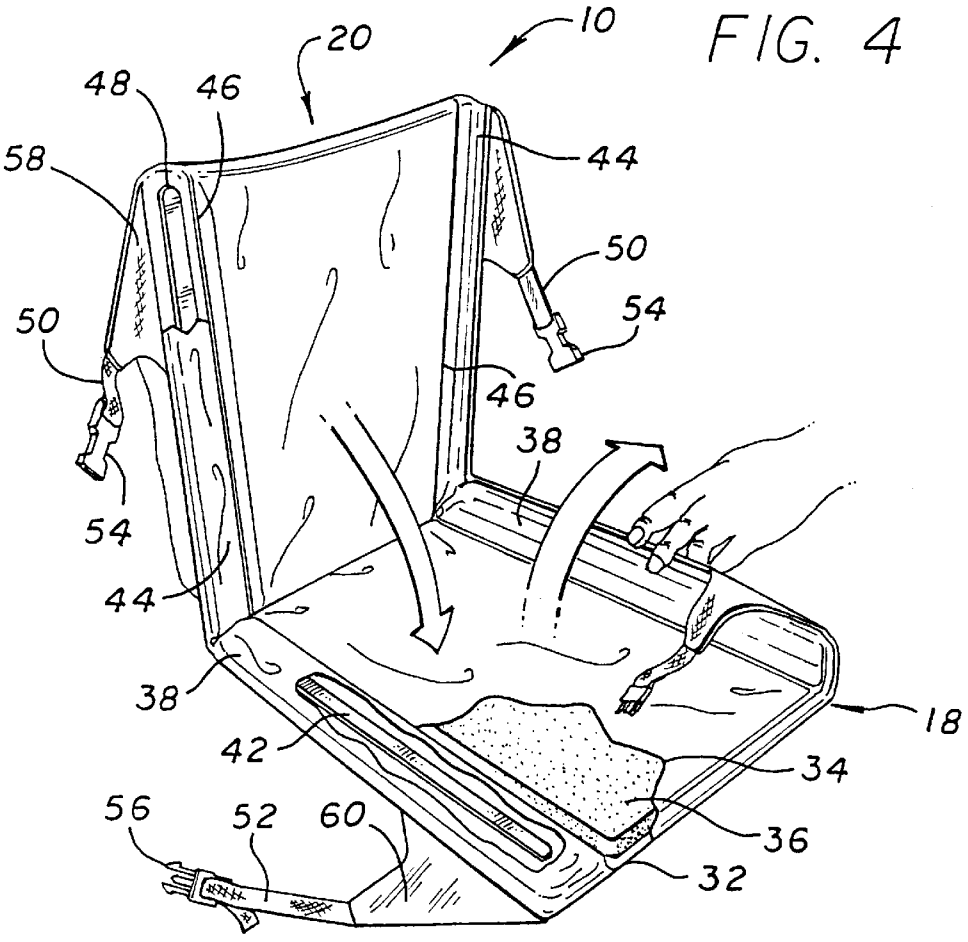
FIG. 4 is a partially exposed front perspective view of the combination backpack and chair at with its wings being opened up.
Figure 5:
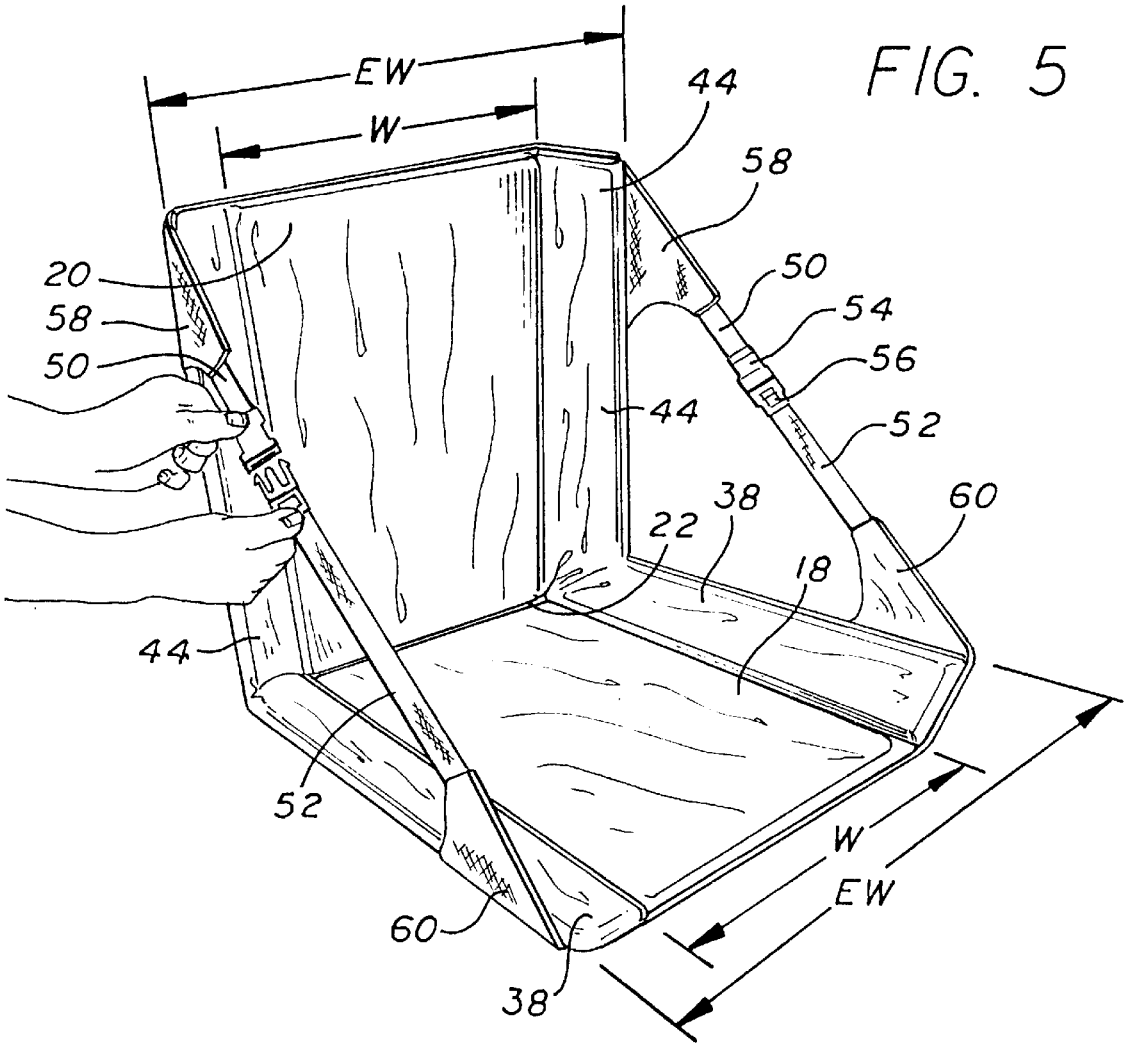
FIG. 5 is a front perspective view of the combination backpack and chair with its straps buckled up to connect its back and seat portions.
Figure 7:
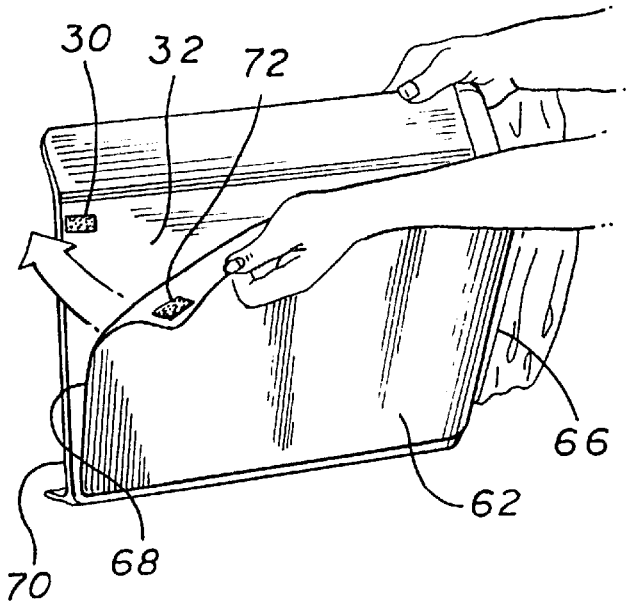
FIG. 7 is a bottom perspective view of the combination backpack and chair with its ground cloth sheet being attached to the bottom of the seat portion.

Referring to FIGS. 4, 5 and 7, a pair of flexible straps 50 and 52 with optional adjustment means 54 and 56, are connected respectively to the chair wings 44 and seat wings 38. To provide for extra strength and a chair back side support, preferably a chair back triangular extension portion 58 extends from an upper region of the chair back wing 44, and a seat portion triangular extension portion 60 extends from a front region of the seat wing 38. The straps 50 and 52 extend from the extension portions 58 and 60. The optional adjustment means 54 and 56 can comprise pairs of rings, snap together clasps and buckles, or other known means. By adjusting the working length of the straps 50 and/or 52, the degree of relative recline of the chair back portion 20 to the seat portion 18 can be readily adjusted. The device 10 can also be made with single straps of a predetermined length without adjustment means, to establish a predetermined degree of recline (not shown.) In the use of the device 10, when the user desires to use the device as a chair, he or she will disengage the retention means 24, and drop the seat portion 18 to free the straps 50 and 52 and their adjustment means 54 and 56. The seat wings 38 and chair back wings 44 will then be folded outwardly to widen the seat and chair back portions 18 and 20.

Figure 6:
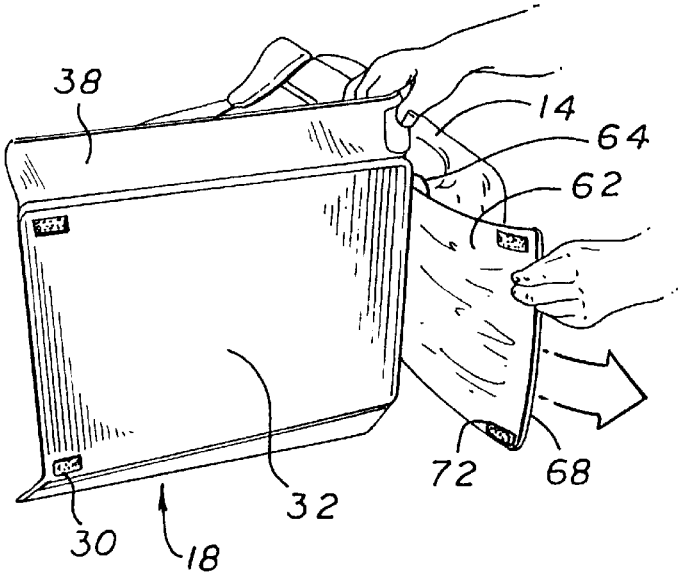
FIG. 6 is a rear side perspective view of the combination backpack and chair with its ground cloth sheet being withdrawn from its pouch for attachment to the bottom of the seat portion.

Referring to FIGS. 6 and 7, a pull out ground cloth sheet 62 can be also provided. It is normally folded into a pocket or cavity 64 formed between the layers of material of the chair back portion 20 and a rear face of the backpack 14, and is attached in the vicinity of its rear region 66 in or near the pocket's 64 opening. Alternately, the ground cloth sheet 62 may be detachably attached to the rest of the backpack 14. When the user desires to sit on a dusty or dirty surface, the pull-out ground cloth sheet 62 will be pulled out so that its leading edge 68 will be placed near the forward edge 70 of the seat portion 18. Patches of hook and loop material 72 complementary to the patches of hook and loop material 30 on the seat portion 18 are used to detachably retain the ground cloth sheet 62 closely against the seat portion 18. This ground cloth sheet 62 prevents the bottom 32 of the seat portion 18 from becoming soiled, and latter transferring this dirt to the backpack wearer's back. The pull out ground cloth sheet 62 is tucked back into its pocket 64 when not in use.

Figure 8:
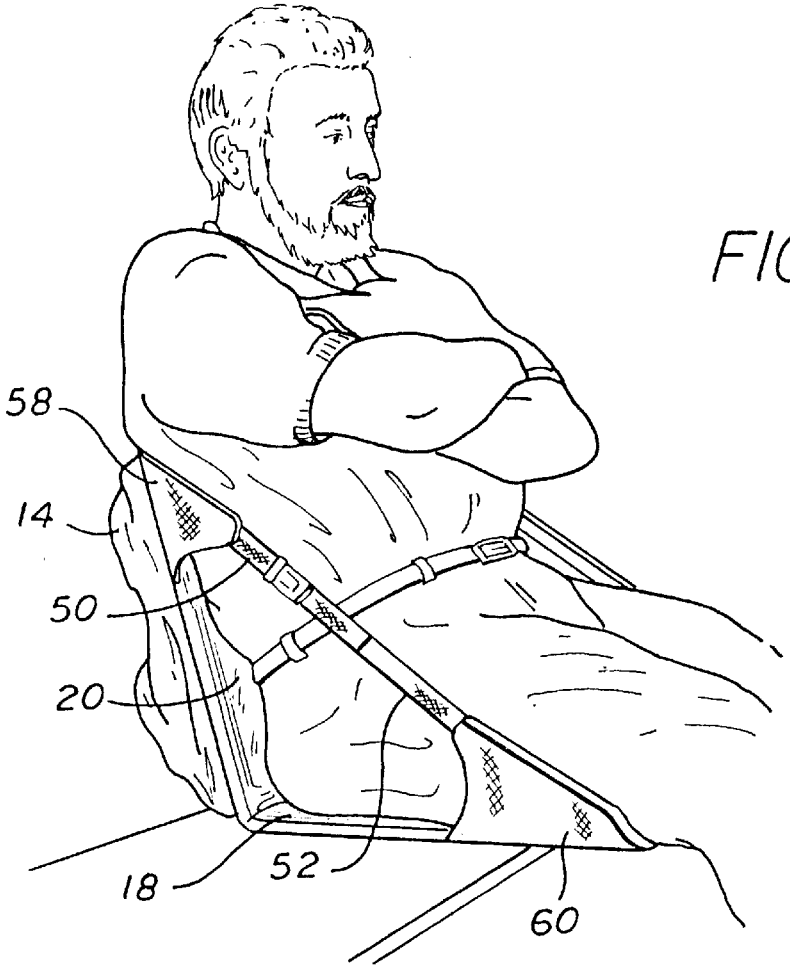
FIG. 8 is a side perspective view of the combination backpack and chair being used by a user.

As shown in FIG. 8, when the device 10 is set up, the resulting seat and chair back will allow the user to sit comfortably anywhere and lean back. Unlike other combination backpack and seats, the device does not need a heavy or bulky frame, and the device looks substantially normal when worn by a wearer. The backpack 14 would also not need to be emptied at all when the seat is being used, but folds out to be wide and comfortable. The overall result is a comfortable, adjustable, lightweight, and easy and quick to set up and break down chair that is available anywhere and anytime.

Figure 9:
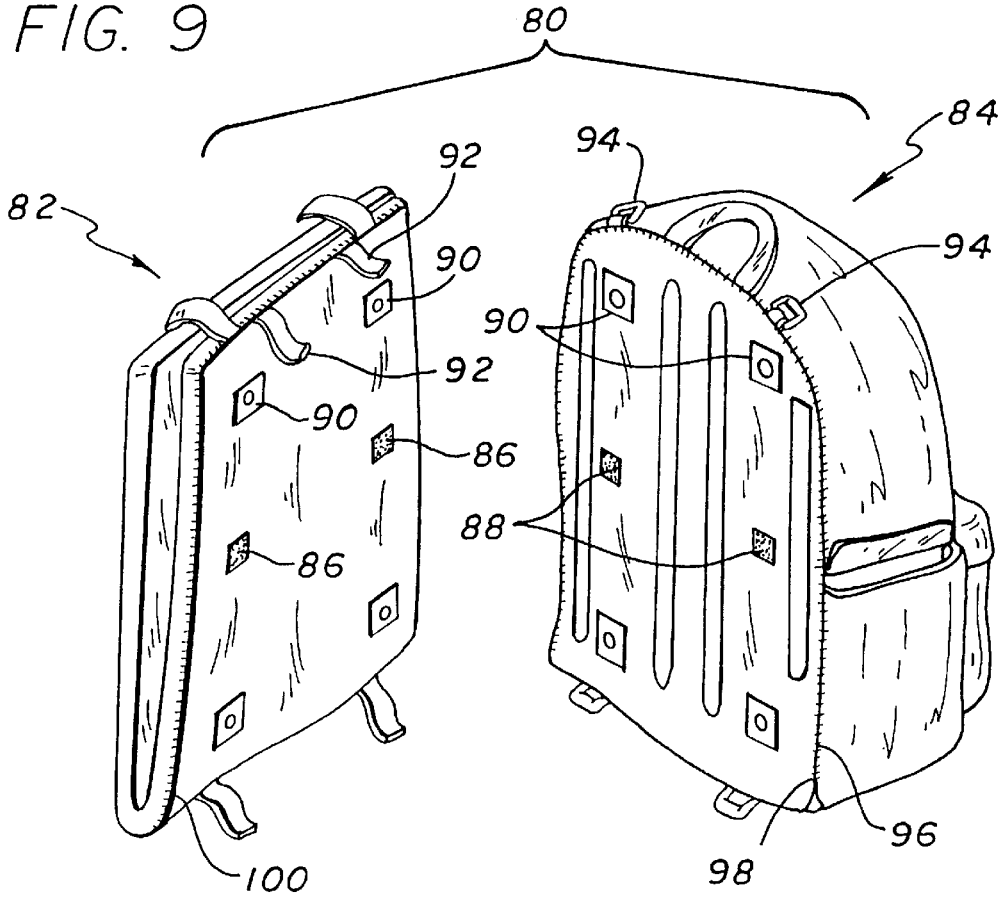
FIG. 9 is a perspective view showing another embodiment of the combination packback and chair of the invention having a detachable chair portion.

Referring to FIG. 9, an alternate embodiment of a backpack and chair 80 of the invention with a detachable reclining chair portion 82 is shown (with the shoulder straps of the backpack portion 84 not being drawn in for clarity.) In this embodiment, instead of being permanently attached to the backpack portion 84, the chair portion 82 (with its chair back and seat portions) is detachably attachable to the back of the backpack portion 84. One or more of detachable attachment means is utilized to accomplish this. The detachable attachment means can comprise, for example, one or more of sections of hook and loop material 86 and 88, snaps 90, straps 92 and loops 94, or a zipper 96 placed around at least a portion of the perimeters 98 and 100 of the backpack portion 84 and the chair portion 82, respectively. One advantage of this embodiment of the backpack and chair back 80 is that a user can temporarily remove the chair portion 84 when he or she does not anticipate needing it, but can quickly reattach it for later use. In all other respects, this embodiment of the combination backpack and chair 80 is similar to the embodiment shown in FIGS. 1–8, as described further above.

Figure 10:
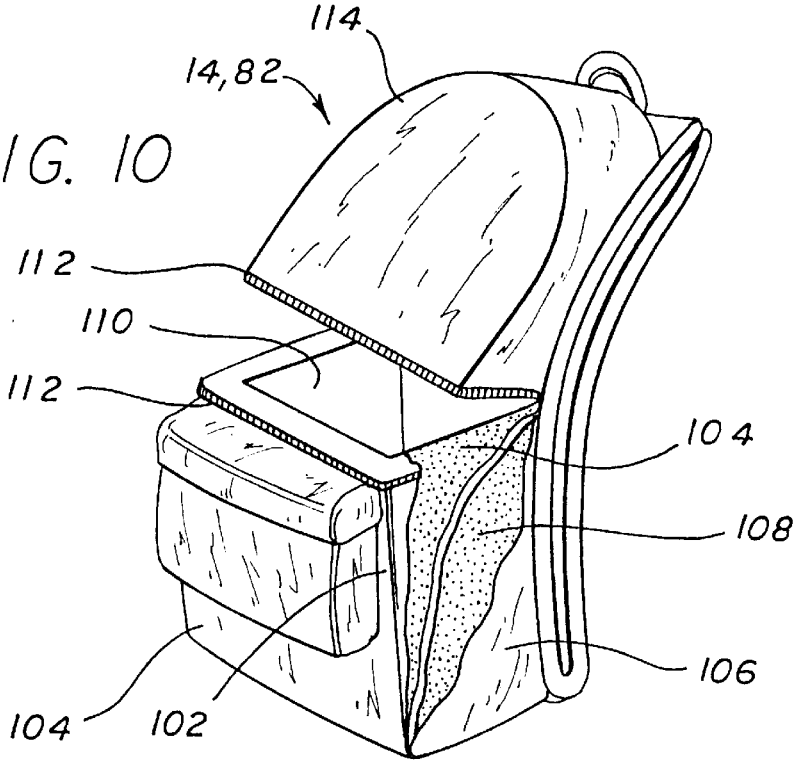
FIG. 10 is a partially exposed view of an alternate embodiment of the backpack portion having a lower insulated portion.

Referring now to FIG. 10, a partially cut-away view of the combination backpack and chairs 10 and 80 of FIGS. 1–9 is shown. The backpack portions 14 and 82 can have incorporated therein an insulated and/or waterproofed lower portion 102. This insulated lower portion 102 can be used to carry foods and beverages that one desires to keep cool, i.e. a six-pack of soft drinks. The lower portion 102 preferably is lined with waterproof material 104, i.e. vinyl, coated nylon, Mylar®, breathable coated nylon fabrics such as Gortex®, and the like. All of the walls 106 surrounding the lower portion 102 are also preferably padded with insulating material 108, such as thin foam rubber, styrofoam, or other known insulating materials. The lower portion 102 preferably is accessible from a top portion 110 which is operable by unzipping a perimeter zipper 112 connecting the lower portion 102 to an upper portion 114 of the backpack 14 or 82.

The drawings and the foregoing description are not intended to represent the only form of the invention in regard to the details of this construction and manner of operation. In fact, it will be evident to one skilled in the art that modifications and variations may be made without departing from the spirit and scope of the invention. Although specific terms have been employed, they are intended in a generic and descriptive sense only and not for the purpose of limitation, the scope of the invention being delineated in the following the claims which follow.

I claim:

1. A combination backpack and chair, comprising:

a backpack portion adapted to carry items;

a chair back portion affixed in an upright position on a rear face of said backpack portion;

a seat portion extending from a lower rear region of said chair back portion;

seat wings which extend outwardly from side regions of said seat portion and chair back wings which extend outwardly from side regions of the chair back portion, said seat wings and chair back wings functioning to effectively widen the seat and chair portions when they are in an open position, said seat wings and chair back wings being adapted to be folded inwardly into contact with the seat and chair back portions when the chair portion is in a closed position; and strap means for connecting said chair back portion and said seat back portion to allow said chair back portion and said seat portion to be arranged at a desired degree of recline relative to each other without affecting said backpack portion's ability to carry items, and without necessitating adjustment of the chair back portion's upright position on said rear face of said backpack portion.

2. The combination backpack and chair of claim 1, wherein said strap means extend from triangular extension portions which extend from side edges of said back and seat wings.

3. The combination backpack and chair of claim 1, wherein the strap means further comprise adjustment means to retain the desired degree of recline between the seat and chair back portions.

4. The combination backpack and chair of claim 1, further comprising generally rigid stays placed in both the seat wings and chair back wings, to provide additional stiffening.

5. The combination backpack and chair of claim 1, further comprising a ground cloth portion to prevent the seat portion from becoming soiled, said ground cloth portion being kept in a pocket located between the chair back portion and the backpack portion when not in use, and being displacable to cover a bottom surface of the seat portion when needed.

6. The combination backpack and chair of claim 1, further comprising retention means to retain said seat and chair back portions in said closed position.

7. The combination backpack and chair of claim 6, wherein the retention means comprises straps with hook and loop material connected to said backpack, which is detachably attachable to complementary hook and loop material placed on an underside of said seat portion.

8. The combination backpack and chair of claim 1, wherein said seat and chair back portions and said wings are padded.

9. The combination backpack and chair of claim 8, wherein said chair back portion and said seat back portion provide extra cushioning to a wearer of the backpack when said seat portion is in a closed portion.

10. The combination backpack and chair of claim 1, wherein said chair back portion and said seat portion are detachably attachable to said backpack by detachable attachment means.

11. The combination backpack and chair of claim 10, wherein said detachable attachment means comprises at least one of hook and loop materials, snaps, straps and loops, and zippers positioned on said chair back portion and on said backpack.

12. The combination backpack and chair of claim 1, wherein said backpack includes an upper and lower portion, said lower portion having insulated and waterproof walls.

13. A combination backpack and chair, comprising:

a backpack portion adapted to carry items;

a chair back portion permanently affixed in an upright position on a rear face of said backpack;

chair back wings which extend from side regions of the chair back portion;

a seat portion extending from a lower rear region of said chair back portion;

seat wings which extend from side regions of said seat portion, said seat wings and chair back wings being foldable inwardly into contact with the seat and chair back portions when the device is not being used as a chair, and which are foldable outwardly when used as a chair; and strap means for interconnecting said chair back portion and said seat back portion to allow said chair back portion and said seat portion to be arranged at a desired degree of recline relative to each other without affecting said backpack portion's ability to carry items, and without necessitating adjustment of the chair back portion's upright position on said rear face of said backpack portion.

14. The combination backpack and chair of claim 13, wherein said strap means extend from triangular extension portions which extend from side edges of said back and seat wings.

15. The combination backpack and chair of claim 13, wherein said strap means have adjustment means to permit adjustment of the strap means to retain the desired degree of recline between the seat and chair back portions.

16. The combination backpack and chair of claim 13, further comprising generally rigid stays placed in both the seat and chair back wings, to provide additional stiffening.

17. The combination backpack and chair of claim 13, further comprising a ground cloth portion to prevent the seat portion from becoming soiled, said ground cloth portion being kept in a pocket located between the chair pack portion and the backpack portion when not in use, and being displacable to cover a bottom surface of the seat portion when needed.

18. The combination backpack and chair of claim 13, further comprising retention means to retain said seat and chair back portions in a closed orientation when they are in a closed orientation.

19. The combination backpack and chair of claim 18, wherein said retention means comprises straps with hook and loop material connected to said backpack, which is detachably attachable to complementary hook and loop material placed on an underside of said seat portion.

20. The combination backpack and chair of claim 13, wherein said seat portion is padded.

21. A combination backpack and chair, comprising:

a backpack portion adapted to carry items;

a chair back portion permanently affixed in an upright position on a rear face of said backpack;

chair back wings which extend from side regions of the chair back portion;

a padded seat portion extending from a lower rear region of said chair back portion;

seat wings which extend from side regions of said seat portion, said seat wings and chair back wings being foldable inwardly into contact with the seat and chair back portions when the device is not being used as a chair, and which are foldable outwardly when used as a chair;

generally rigid stays placed in both the seat and chair back wings to provide additional stiffening;

strap means for interconnecting said chair back portion and said seat back portion to allow said chair back portion and said seat portion to be arranged at a desired degree of recline relative to each other;

adjustment means to permit adjustment of the working length of said strap means so the degree of recline between the seat and chair back portions can be adjusted;

a ground cloth portion to prevent the seat portion from becoming soiled, said ground cloth portion being kept in a pocket located between the chair back portion and the backpack portion when not in use, and being displaceable to cover a bottom surface of the seat portion when needed, and retention means to selectively maintain said seat and chair back portions in a closed orientation when desired without affecting said backpack portion's ability to carry items.

22. The combination backpack and chair of claim 21, wherein said strap means extend from triangular extension portions which extend from side edges of said back and seat wings.

23. A combination backpack and chair, comprising:

a backpack portion adapted to carry items;

a chair back portion permanently affixed in an upright position on a rear face of said backpack portion;

a seat portion extending from a lower rear region of said chair back portion;

seat wings which extend outwardly from side regions of said seat portion and chair back wings which extend outwardly from side regions of the chair back portion, said seat wings and chair back wings functioning to effectively widen the seat and chair portions when they are in an open position, said seat wings and chair back wings being adapted to be folded inwardly into contact with the seat and chair back portions when the chair portion is in a closed position;

a ground cloth portion to prevent said seat portion from becoming soiled, said ground cloth portion being kept in a pocket located between the chair back portion and the backpack portion when not in use, and being displaceable to cover a bottom surface of the seat portion when needed; and strap means for connecting said chair back portion and said seat back portion to allow said chair back portion and said seat portion to be arranged at a desired degree of recline relative to each other without affecting said backpack portion's ability to carry items.

24. A combination backpack and chair, comprising:

a backpack portion adapted to carry items;

a chair back portion permanently affixed in an upright position on a rear face of said backpack portion;

a seat portion extending from a lower rear region of said chair back portion;

seat wings which extend outwardly from side regions of said seat portion and chair back wings which extend outwardly from side regions of the chair back portion, said seat wings and chair back wings functioning to effectively widen the seat and chair portions when they are in an open position, said seat wings and chair back wings being adapted to be folded inwardly into contact with the seat and chair back portions when the chair portion is in a closed position;

a retention means to retain said seat and chair back portions in a closed orientation when desired which comprises straps with hook and loop material connected to said backpack, which is detachably attachable to complementary hook and loop material placed on an underside of said seat portion; and strap means for connecting said chair back portion and said seat back portion to allow said chair back portion and said seat portion to be arranged at a desired degree of recline relative to each other without affecting said backpack portion's ability to carry items.

25. A combination backpack and chair, comprising:

a backpack portion adapted to carry items which includes an upper and lower portion, said lower portion having insulated and waterproof walls;

a chair back portion permanently affixed in an upright position on a rear face of said backpack portion;

a seat portion extending from a lower rear region of said chair back portion;

seat wings which extend outwardly from side regions of said seat portion and chair back wings which extend outwardly from side regions of the chair back portion, said seat wings and chair back wings functioning to effectively widen the seat and chair portions when they are in an open position, said seat wings and chair back wings being adapted to be folded inwardly into contact with the seat and chair back portions when the chair portion is in a closed position; and strap means for connecting said chair back portion and said seat back portion to allow said chair back portion and said seat portion to be arranged at a desired degree of recline relative to each other without affecting said backpack portion's ability to carry items.

26. A combination backpack and chair, comprising:

a backpack portion adapted to carry items;

a chair back portion permanently affixed in an upright position on a rear face of said backpack;

chair back wings which extend from side regions of the chair back portion;

a seat portion extending from a lower rear region of said chair back portion;

seat wings which extend from side regions of said seat portion, said seat wings and chair back wings being foldable inwardly into contact with the seat and chair back portions when the device is not being used as a chair, and which are foldable outwardly when used as a chair;

a ground cloth portion to prevent said seat portion from becoming soiled, said ground cloth portion being kept in a pocket located between the chair back portion and the backpack portion when not in use, and being displaceable to cover a bottom surface of the seat portion when needed; and strap means for interconnecting said chair back portion and said seat back portion to allow said chair back portion and said seat portion to be arranged at a desired degree of recline relative to each other without affecting said backpack portion's ability to carry items.

27. A combination backpack and chair, comprising:

a backpack portion adapted to carry items;

a chair back portion permanently affixed in an upright position on a rear face of said backpack;

chair back wings which extend from side regions of the chair back portion;

a seat portion extending from a lower rear region of said chair back portion;

seat wings which extend from side regions of said seat portion, said seat wings and chair back wings being foldable inwardly into contact with the seat and chair back portions when the device is not being used as a chair, and which are foldable outwardly when used as a chair;

a retention means to retain said seat and chair back portions in a closed orientation when desired which comprises straps with hook and loop material connected to said backpack, which is detachably attachable to complementary hook and loop material placed on an underside of said seat portion; and strap means for interconnecting said chair back portion and said seat back portion to allow said chair back portion and said seat portion to be arranged at a desired degree of recline relative to each other without affecting said backpack portion's ability to carry items.

* * * * *